US006131549A

United States Patent [19]

Onishi

[11] Patent Number: 6,131,549

[45] Date of Patent: Oct. 17, 2000

[54] HIGH PRESSURE FUEL PUMPING APPARATUS

[75] Inventor: Yoshihiko Onishi, Tokyo, Japan

[73] Assignee: Mitsubishi Denki Kabushiki Kaisha, Tokyo, Japan

[21] Appl. No.: 09/249,784

[22] Filed: Feb. 16, 1999

[30] Foreign Application Priority Data

Oct. 14, 1998 [JP] Japan ..... 10-292007

[51] Int. Cl.[7] ..... F02M 37/04

[52] U.S. Cl. ..... 123/495; 123/514

[58] Field of Search ..... 123/495, 445, 123/457, 458, 198 D

[56] References Cited

U.S. PATENT DOCUMENTS

| | | | |
|---|---|---|---|
| 4,869,219 | 9/1989 | Bremmer et al. | 123/383 |
| 5,709,197 | 1/1998 | Oshidari et al. | 123/514 |
| 5,731,515 | 3/1998 | Tominaga et al. | 73/119 A |
| 5,832,904 | 11/1998 | Morishita et al. | 123/514 |

FOREIGN PATENT DOCUMENTS

| | | | |
|---|---|---|---|
| 31 40 742 | 4/1983 | Germany | F04B 21/00 |
| 7-12029 | 1/1995 | Japan | F02M 59/44 |

OTHER PUBLICATIONS

Patent Abstracts of Japan vol. 098, No. 011, Sep. 30, 1998 & JP 10 176625 A (Unisia Jecs Corp) Sep. 30, 1998.

*Primary Examiner*—Thomas N. Moulis
*Attorney, Agent, or Firm*—Sughrue, Mion, Zinn, Macpeak & Seas, PLLC

[57] ABSTRACT

In a high pressure fuel pumping apparatus 3, a drain passage 12 for fuel having leaked from the inside of a fuel sealing metallic bellows 26, and another drain passage 13 for a high pressure fuel regulator 8 for regulating the pressure discharged from the high pressure fuel pumping apparatus are merged at a merging point. A lead type of check valve 17 is located upstream in the drain passage 12 between the merging point 14 and the fuel sealing metallic bellows 26, and a ball type of check valve 18 is located downstream in the drain passage 12.

6 Claims, 5 Drawing Sheets

HIGH PRESSURE FUEL PUMPING APPARATUS

BACKGROUND OF THE INVENTION

1. Field of the Invention

The present invention relates to an improvement of a high pressure fuel pumping apparatus, and more particularly to a high pressure pumping apparatus used for an in-cylinder jet gasoline engine.

2. Description of the Related Art

Referring to FIG. 6, an explanation will be given of a related high pressure fuel pumping apparatus.

In FIG. 6, reference numeral 1 denotes a fuel jet valve for directly jetting fuel into each of cylinders of an engine (not shown). Reference numeral 2 denotes a delivery pipe for supplying fuel to the fuel jet valve. Reference numeral 3 denotes a high pressure fuel pumping apparatus for supplying the high pressure fuel into the delivery pipe 2 through a high pressure fuel supply passage 4. Reference numeral 5 denotes a high pressure fuel pump of a piston type. Reference numeral 6 denotes an inhalation valve for the high pressure fuel pump, which is constructed from a lead valve. Reference numeral 7 denotes a discharge valve for the high pressure fuel pump, which is constructed from a lead valve. Reference numeral 8 denotes a high pressure fuel regulator for regulating the fuel pressure of fuel discharged from the high pressure fuel pump 5 at a prescribed value. Reference numeral 9 denotes a high pressure damper mounted between the high pressure fuel regulator 8 and the high pressure fuel pump 5. Reference numeral 10 denotes a low pressure fuel passage which is connected to a low pressure fuel pump (not shown). Reference numeral 11 denotes a low pressure damper. Reference numeral 12 denotes a drain passage for returning the fuel having leaked from a gap between the sleeve and piston of the high pressure fuel pump 5 toward a fuel tank. Reference numeral 13 denotes a drain passage for the high pressure fuel regulator 8. Reference numeral 14 denotes emerging point of the drain passages 12 and 13. Reference numeral 15 denotes a returning passage which is communicated with the fuel tank (not shown) Reference numeral 16 denotes a check valve which is arranged on the drain passage 12 for the high pressure fuel pump 5, which is constructed from a ball valve.

In the related pumping apparatus having a structure described above, the check valve 16 is arranged in the drain passage 12 for the high pressure fuel pump 5, and the amount of the fuel which has leaked from a gap between the sleeve and piston of the high pressure fuel pump 5 stands within a high pressure fuel drain chamber, thereby preventing the pressure of the drain chamber from being boosted and a fuel sealing metallic bellows from being broken.

The check valve 16 of the related apparatus serves to prevent the fuel in the drain passage 13 for the high pressure fuel regulator 8 from flowing backward into the drain chamber of the high pressure fuel pump 5.

The check valve 16 of the related pumping apparatus serves to discharge the fuel standing within the drain chamber of the high pressure fuel pump 5 and to prevent the fuel in the drain passage 13 for the high pressure fuel regulator 8 from flowing backward into the drain chamber of the high pressure fuel pump 5.

However, the above check valve 16, which is constructed from a ball valve, provides poor response property for the high pressure fuel pump. Therefore, the fuel stands too much within the drain chamber of the high pressure fuel pump 5, so that the internal pressure of the drain chamber increases.

This will deteriorate the endurance of the fuel sealing metallic bellows constructing the inside of the drain chamber.

SUMMARY OF THE INVENTION

The present invention has been accomplished in order to solve the above problem.

An object of the present invention is to provide a high pressure fuel pump apparatus which can improve the endurance of a fuel sealing metallic bellows and can be manufactured with high reliability and at low cost.

To solve the above object, there is provided a high pressure fuel pumping apparatus including: a fuel sealing metallic bellows for preventing fuel having leaked from a gap between a sleeve and a piston reciprocating therewithin from leaking out, a first drain passage for fuel having leaked from the inside of the bellows, and a second drain passage for a high pressure fuel regulator for regulating the pressure discharged from the high pressure fuel pumping apparatus to a prescribed value, the first and the second drain passage being merged at a merging point, a first check valve located upstream in the first drain passage between the merging point and the bellows, and a second check valve located downstream in the first drain passage.

Additionally, the first check valve may constructed from a check valve with good response and the second check valve may constructed from another check valve having good sealing property.

Here, the first check valve may constructed from a lead type of check valve and the second check valve may constructed from a ball type of check valve.

Moreover, the first check valve and the second check valve may integrally mounted in a casing for housing the sleeve.

Further, the first check valve may formed integrally to a lead valve for inhalation and discharging in a pumping chamber formed by the sleeve and the piston.

In addition, the high pressure regulator is mounted integrally with the high pressure fuel pumping apparatus.

BRIEF DESCRIPTION OF THE DRAWINGS

Similar reference characters denote corresponding features consistently throughout the attached figures. The preferred embodiments of this invention will be described in detail, with reference to the following figures, wherein.

DETAILED DESCRIPTION OF THE PREFERRED EMBODIMENT

[Embodiment 1]

Figure 1:
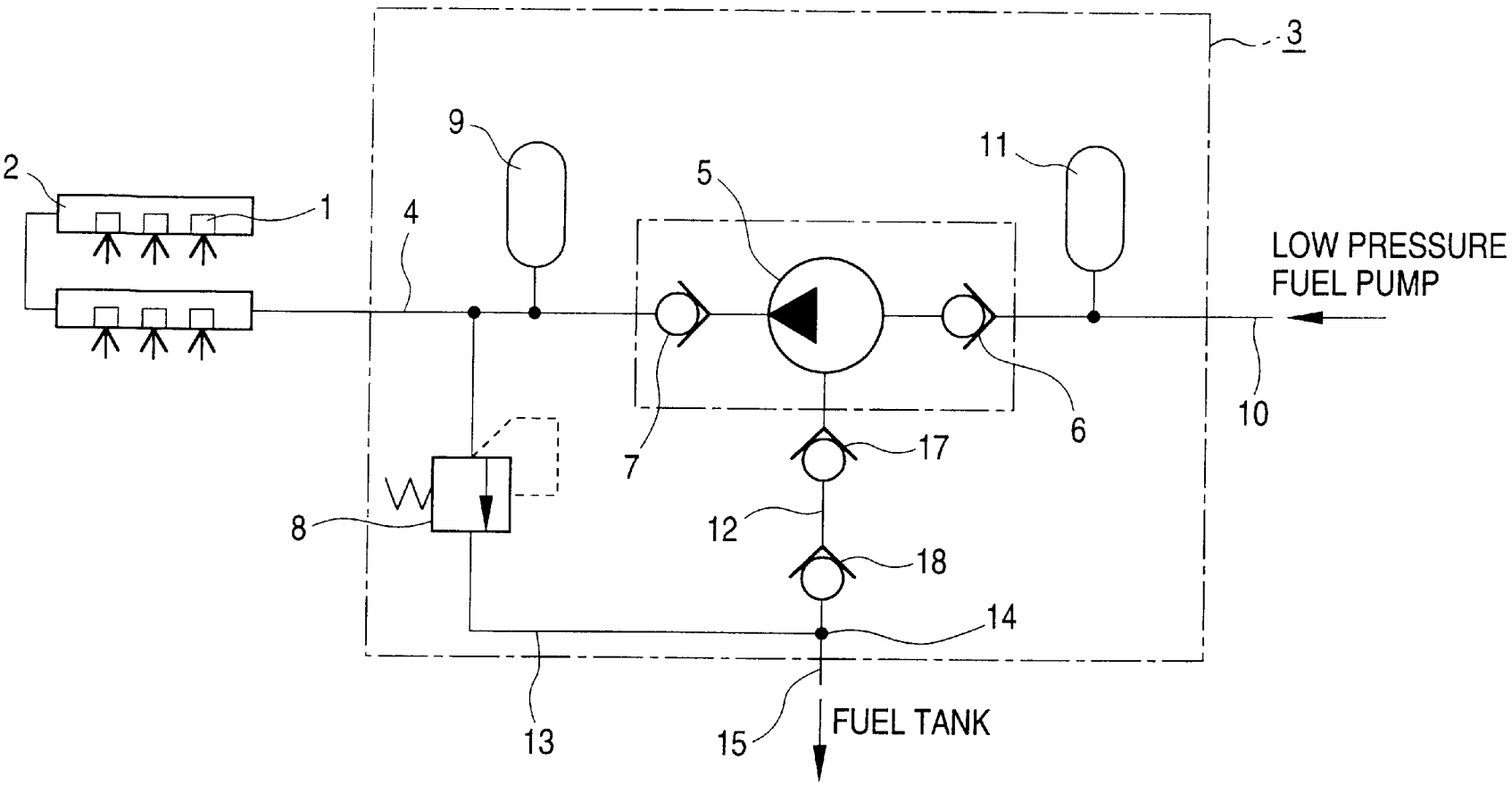
FIG. 1 is a block diagram showing the configuration of the high pressure fuel pumping apparatus according the first embodiment of the present invention.
Figure 2:
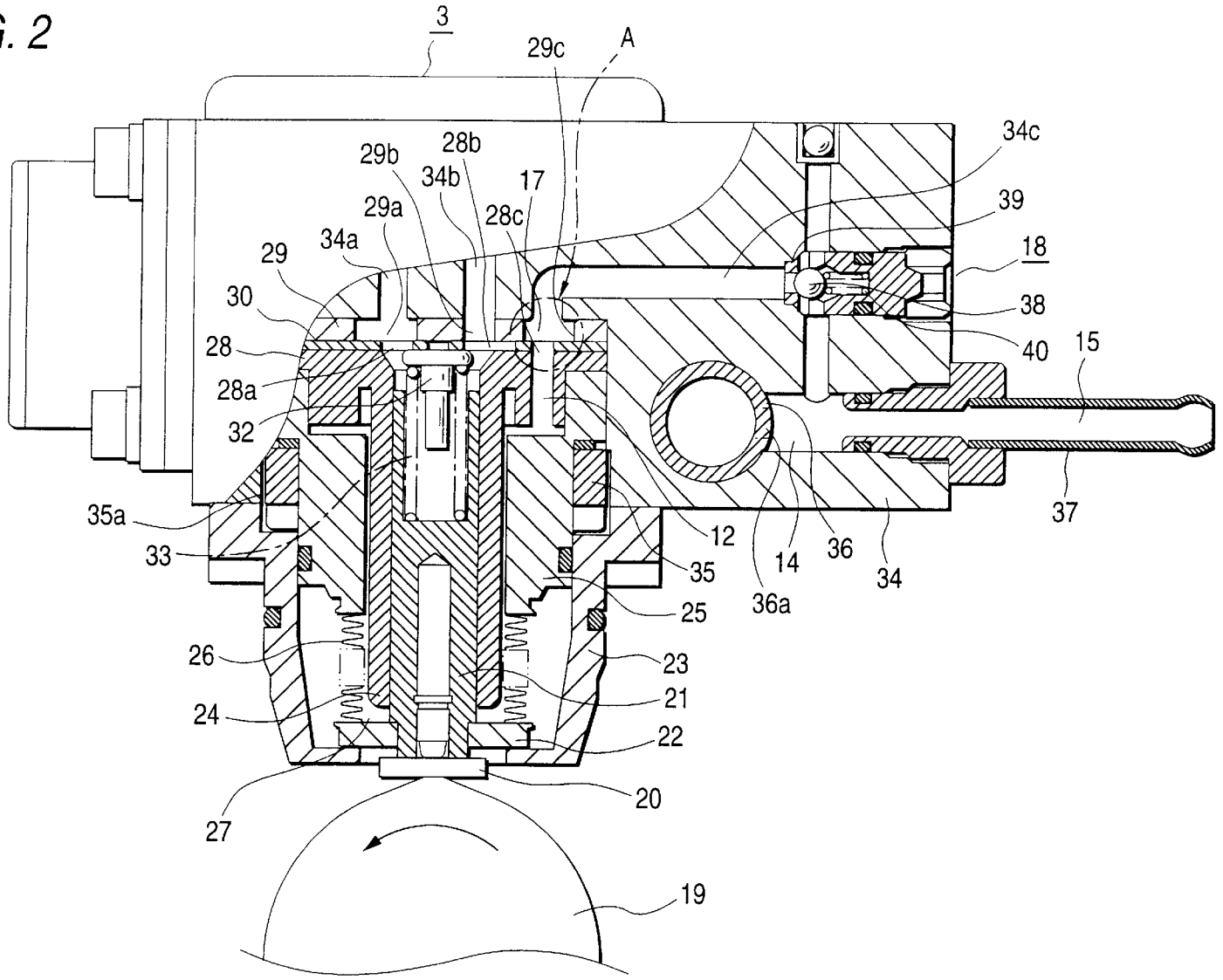
FIG. 2 is a sectional view showing the construction of the high pressure fuel pumping according to the first embodiment of the present invention.
Figure 3:
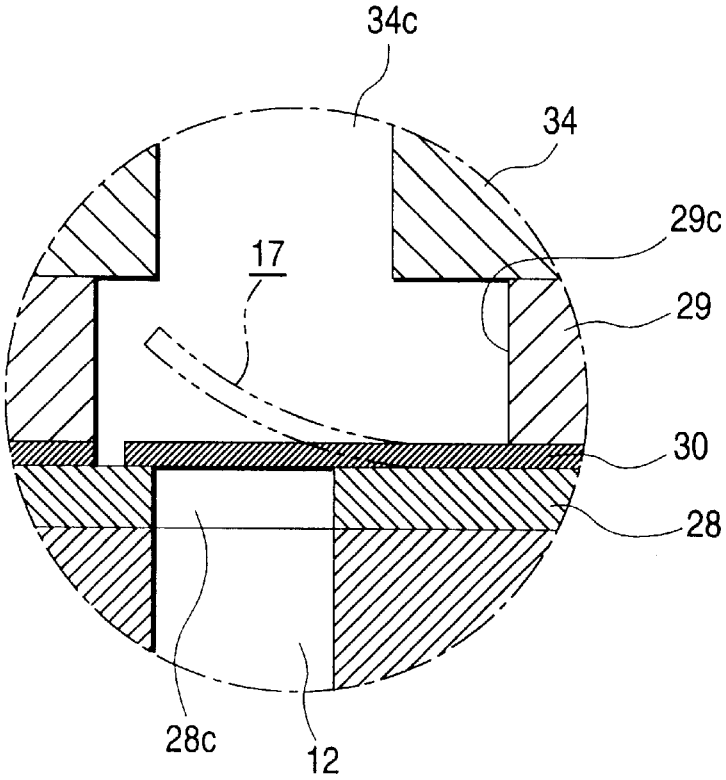
FIG. 3 is a sectional view of an enlarged portion of FIG. 2 showing the first embodiment of the present invention.
Figure 4:
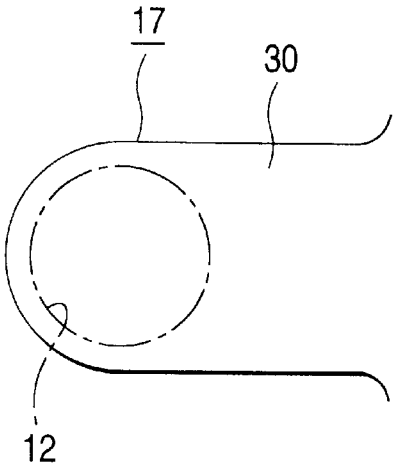
FIG. 4 is a plan view of an enlarged portion of FIG. 2 showing the first embodiment of the present invention.

FIG. 1 is a block diagram showing the arrangement of a high pressure fuel pumping apparatus according to an embodiment of the present invention. FIG. 2 is a sectional view of the details of the high pressure fuel pumping apparatus according to the embodiment of the present invention. FIG. 3 is an enlarged sectional view of the main part viewed by an arrow A in FIG. 2. FIG. 4 is an enlarged plan view of the main part of the arrow A in FIG. 2.

As seen from FIG. 1, a first check valve 17 with good response and of a lead type is arranged upstream in the drain passage 12 between a merging point 14 and the fuel sealing metallic bellows of the high pressure fuel pump 5.

A second check valve 18 with good sealing property and of a ball type is arranged downstream in the drain passage 12 between a merging point 14 and the fuel sealing metallic bellows of the high pressure fuel pump 5.

In FIGS. 2 to 4, reference numeral 19 denotes a cam which is driven by ½ rotation of an engine (not shown) and has a plurality of cam threads, e.g. six cam threads. Reference numeral 20 denotes a tappet in contact with the cam 19. Reference numeral 21 denotes a piston arranged integrally to the tappet 20. The piston 21 is reciprocatively driven by the cam 19 through the tappet 20. Reference numeral 22 denotes a holder provided at the lower end of the piston. Reference numeral 23 denotes a bracket which supports the tappet slidably.

Reference numeral 24 denotes a sleeve which supports the piston 21 reciprocatably and constitutes a pumping chamber serving as a fuel pressurizing chamber. Reference numeral 25 denotes a housing which surrounds and supports the sleeve 21. Reference numeral 26 denotes a fuel sealing metallic bellows one end of which is fixed to the holder 22 attached to the piston 21 and the other end of which is fixed to the housing 25. The fuel metallic bellows 26 serves to store the fuel leaked from between the piston 21 and sleeve 24. Reference numeral 27 denotes a drain chamber which stores the leaked fuel.

Reference numeral 28 denotes a plate A mounted on the sleeve 24, which has an inhalation hole 28*a*, a discharging hole 28*b* and a return hole 28*c*. Reference numeral 29 denotes a plate B which is arranged to sandwich a lead valve 30 between itself and the plate A 28. The plate B 29 has an inhalation hole 29*a*, a discharging hole 29*b* and a return hole 29*c*. The lead valve 30 has unidirectional valves for inhalation and discharging and a drain check valve 17 for return.

Reference numeral 32 denotes a spring guide which is kept in contact with the plate A 28. Reference numeral 33 denotes a compressing coil spring hung between the spring guide 32 and the piston 21. The compressing coil spring 33 always presses the piston 21 towards the tappet 20.

Reference numeral 33 denotes a casing which has an inhalation passage 34*a*, a discharging passage 34*b* and a drain passage 34*c*, and houses the piston 21 and sleeve 24, etc. Within the casing 34, the check valve 17 of a lead type and the check valve 18 of a ball type are integrally formed. The drain passage 34*c* of the casing 34 constitutes a drain passage 12 which communicates with the drain chamber 27 of the high pressure fuel pump 5.

Reference numeral 35 denotes a tightening screw crimped on the outer periphery of the housing 25. On the outer periphery of the tightening screw 35, a screw thread 35*a* to be screwed with the casing 34 is formed. By means of the tightening screw 35, the housing 25 and casing 34 are integrally fixed to each other. Reference numeral 36 denotes a drain conduit which constitutes a drain passage 13 of the high pressure fuel regulator 8 integrally attached to the casing 34, and has an opening 36*a* to be communicated with the merging point 14.

Reference numeral 37 denotes a return conduit which constitutes a return passage 15 communicating with the fuel tank. Reference numeral 38 denotes a metallic ball which constitutes a second check valve 18 of the ball type. Reference numeral 39 denotes a valve seat fixed to the casing 34, which constitutes a unidirectional valve together with the ball 38.

Reference numeral 40 denotes a compressing coil spring which always compresses the ball 38 towards the valve seat 39.

As shown in enlarged views of FIGS. 3 and 4, the lead type of check valve 17 itself is made in the form of a tongue piece of a plate spring. As indicated by solid line, the check valve 17 closes the return hole 28*c* as indicated by solid line until a prescribed drain side fuel pressure occurs. When the prescribed drain side fuel pressure occurs, the return hole 28*c* opens with good response as indicated by two-dot chain line in FIG. 3.

Although not shown in detail in FIG. 2, the high pressure fuel regulator 8, high pressure damper 9 and low pressure damper 11 are integrally mounted in the casing 34 of the high pressure fuel pumping apparatus 3, respectively.

In the first embodiment thus configured, the piston 21 is reciprocated by rotation of the cam 19 through the tappet 20. While the piston 21 descends, fuel flows from the low pressure fuel passage 10 into the pumping chamber through the fuel inhalation passage 34*a*, inhalation opening 29*a* of the plate B 29, inhalation valve of the lead valve 30 and inhalation hole 28*a* of the plate A 28.

While the piston 21 ascends, the inhalation valve of the lead valve 30 closes and the discharging valve thereof opens so that the fuel within the pumping chamber is discharged through the discharging hole 29*b* of the plate B 29 and discharging passage 34*b*.

On the other hand, the fuel leaking from between the piston 21 and the sleeve 24 is prevented from being leaked externally by the metallic bellows 26. The fuel having leaked from the inside of the metallic bellows 26 flows into the check valve 18 through the return hole of the sleeve 24, drain passage 12, return hole 28*c* of the plate A 28, check valve 17, return hole 29*c* of the plate B 29 and drain passage 34*c*. The fuel flows toward the merging point 14 through the drain passage 12 from the check valve 18, and is returned to the fuel tank through the return passage 15.

In the first embodiment, the lead type of the check valve 17 with good response is arranged upstream in the drain passage 12 of the high pressure fuel pump 5 and the ball type of the check valve 18 with good sealing property is arranged downstream therein. For this reason, when the leaked fuel stands in the drain chamber 27, and when its pressure reaches prescribed pressure, the lead type of check valve 17 opens with good response and then the ball type of check valve 18 with good sealing property opens. Thus, the fuel standing within the drain chamber 27 of the high pressure fuel can be surely returned to the fuel tank through the drain passage 12 and the return passage 15.

The fuel on the drain side which has reached the merging point 14 through the drain passage 13 from the high pressure fuel regulator 8 can be surely prevented from flowing backward to the drain chamber 27 of the high pressure fuel pump 5 by the check valve 18.

Further, since the drain check valve 17 is formed in the lead valve 30 for inhalation/discharging of the high-pressure fuel pump 5, the check valve with good response can be provided at low cost without increasing the number of components.

[Embodiment 2]

Figure 5:
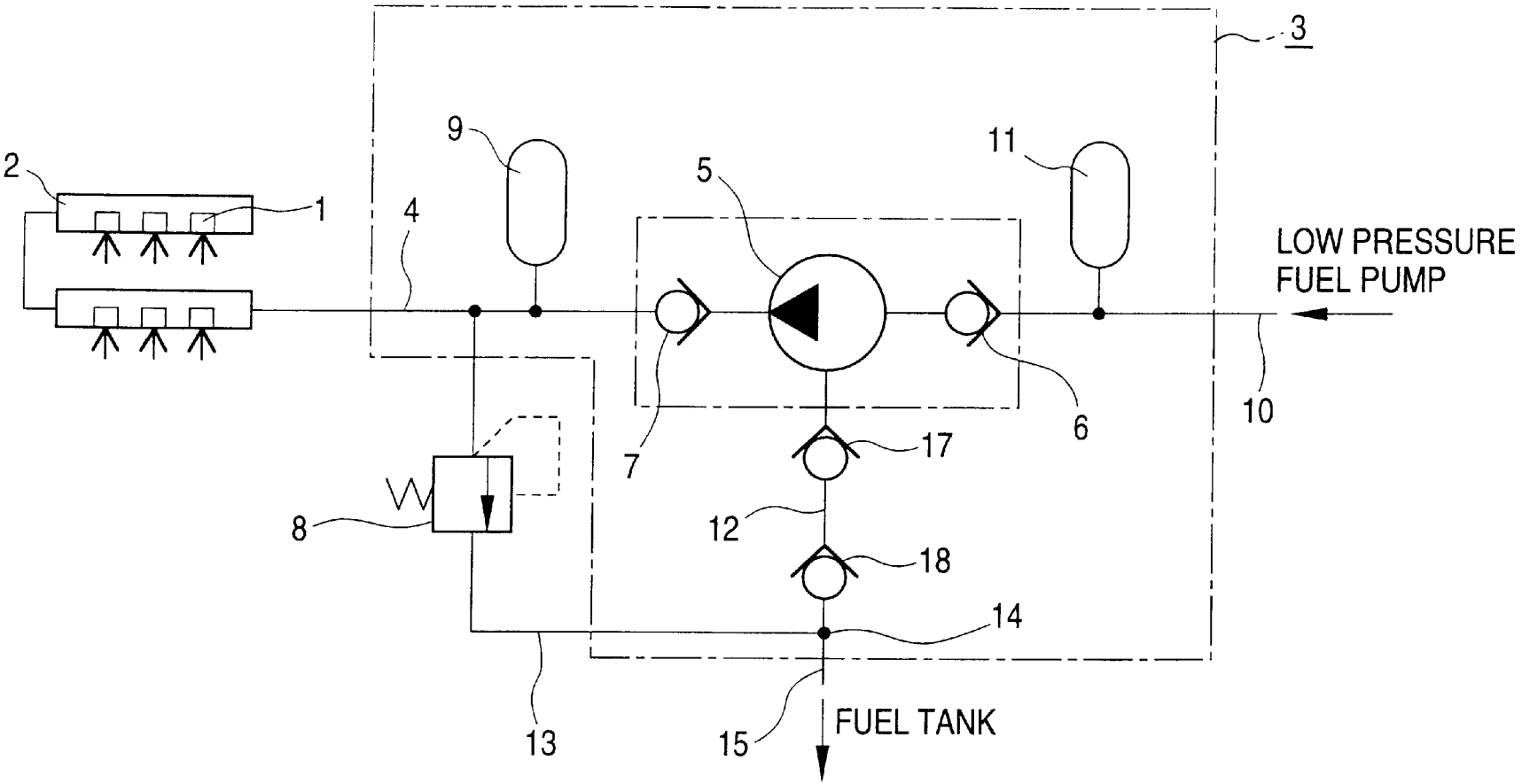
FIG. 5 is a block diagram showing the construction of the high pressure fuel pumping apparatus according to the second embodiment of the present invention.
Figure 6:
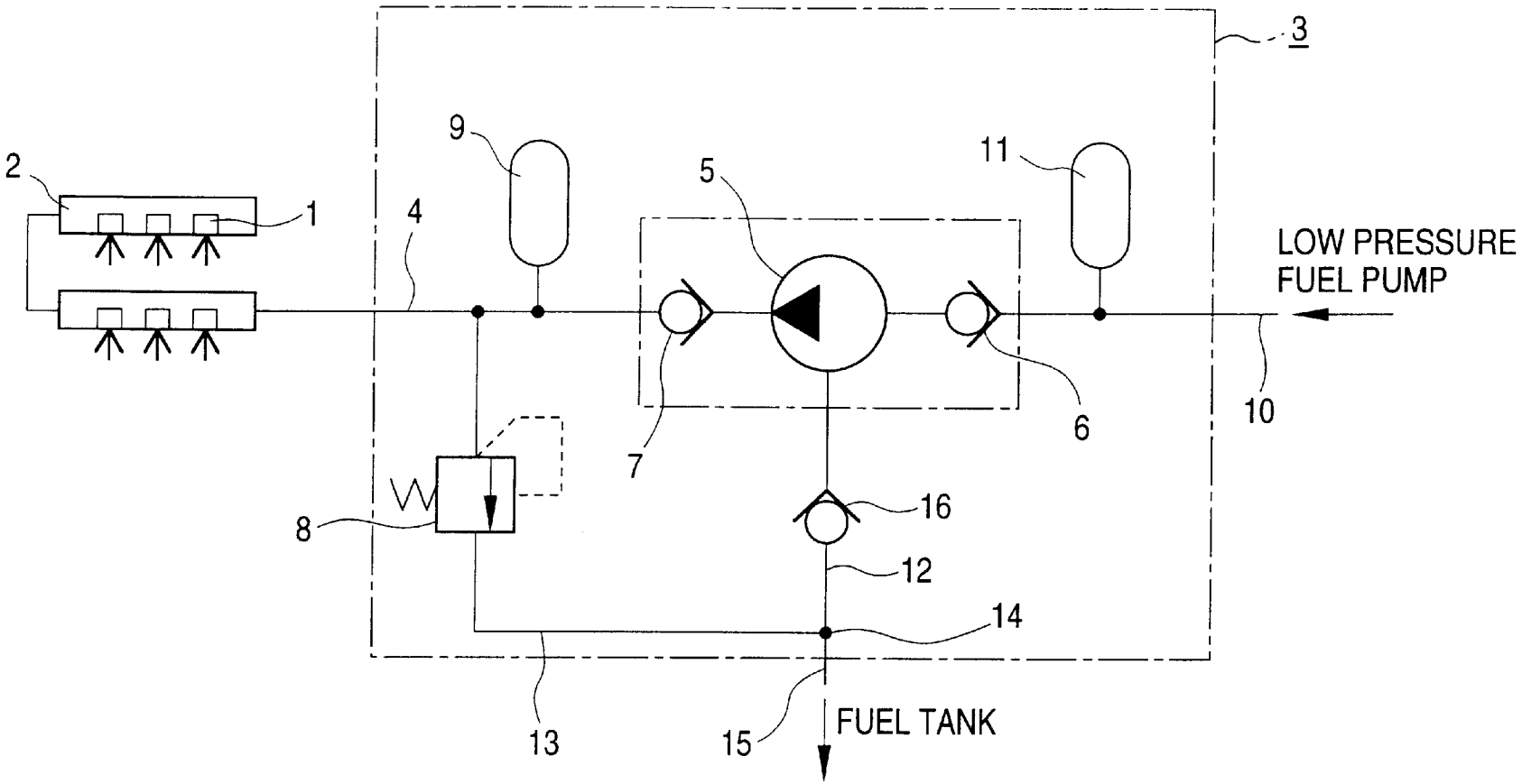
FIG. 6 is a block diagram showing a related high pressure fuel pumping apparatus.

As shown in FIG. 5, the high pressure fuel regulator 8 can be constituted as a body separated from the casing 3 of the high pressure fuel pump 5.

The second embodiment can provide the same effect as the first embodiment.

[Embodiment 3]

In the embodiments described above, the check valve 18 which constitutes the second check valve is formed of a metallic ball. However, the ball may be made of ceramic. This reduces the weight of the check valve to improve the response.

[Embodiment 4]

In the embodiments described above, the first check valve is constructed from the lead type of check valve 17 with good response and the second check valve is constructed from the ball type of check valve 18 having good sealing property. However, these first and second check valves may be constructed from the lead type of check valves, respectively, or alternatively by ball type of check valves, respectively. In short, two check valves are arranged on the drain passage between the fuel sealing metallic bellows 26 and the merging point 14 so that the fuel flowing backward toward the metallic bellows 26 through the drain passage 13 of the high pressure fuel regulator 8 and merging point 14 can be effectively sealed.

In accordance with a first aspect of the present invention, in a high pressure fuel pumping apparatus having a fuel sealing metallic bellows for preventing fuel having leaked from a gap between a sleeve and a piston reciprocating therewithin from leaking out, a first drain passage for fuel having leaked from the inside of the bellows and a second drain passage for a high pressure fuel regulator for regulating the pressure discharged from the high pressure fuel pumping apparatus to a prescribed value are merged at a merging point; and a first check valve is located upstream in the first drain passage between the merging point and the bellows, and a second check valve is located downstream in the first drain passage. In such a configuration, a backward flow of the fuel from the high pressure fuel regulator can be prevented. For this reason, an increase in the internal pressure of a drain chamber can be prevented and the endurance of the fuel sealing metallic bellows can be improved. In addition, the pulsation occurring in the drain passage of the high pressure fuel pumping apparatus can be reduced, and when the pulsation propagates to a drain conduit, generation of unusual sound due to vibration of the conduit can be prevented.

In accordance with a second aspect of the present invention, the first check valve is constructed from a check valve with good response and the second check valve is constructed from another check valve having good sealing property. In such a configuration, the fuel having stood in the drain chamber constructed from the fuel sealing metallic bellows can be exhausted with good response, and a backward flow of the fuel from the high pressure fuel regulator can be prevented. For this reason, an increase in the internal pressure of a drain chamber can be prevented with good response and the endurance of the fuel sealing metallic bellows can be improved. In addition, the pulsation occurring in the drain passage of the high pressure fuel pumping apparatus can be reduced, and when the pulsation propagates to a drain conduit, generation of unusual sound due to vibration of the conduit can be prevented.

In accordance with a third aspect of the present invention, the first check valve is constructed from a lead type of check valve and the second check valve is constructed from a ball type of check valve. In such a configuration, the fuel having stood in the drain chamber constructed from the fuel sealing metallic bellows can be exhausted with good response, and a backward flow of the fuel from the high pressure fuel regulator to the drain chamber can be prevented. For this reason, an increase in the internal pressure of a drain chamber can be prevented with good response and the endurance of the fuel sealing metallic bellows can be improved. In addition, the apparatus is simple in the configuration and can be manufactured at low cost. Further, the pulsation occurring in the drain passage of the high pressure fuel pumping apparatus can be reduced, and when the pulsation propagates to a drain conduit, generation of unusual sound due to vibration of the conduit can be prevented.

In the high pressure fuel pumping apparatus having a fourth aspect of the present invention, the first check valve and the second check valve are integrally mounted in a casing for housing the sleeve. In such a configuration, the construction of each check valve can be simplified and the passage of communicating these check valves can be shortened.

In accordance with the high pressure fuel pumping apparatus in a fifth aspect of the present invention, the first check valve is attached integrally to a lead valve for inhalation and discharging in a pumping chamber formed by the sleeve and the piston. In such a configuration, without increasing the number of components, an inexpensive check valve with good response can be provided.

In accordance with a sixth aspect of the present invention, the high pressure regulator mounted is integrally mounted. In this configuration, the merging point of the drain passages from the fuel sealing metallic bellows and from the high pressure fuel regulator can be easily formed so that the functions of the first and the second valve can be exhibited sufficiently.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A high pressure fuel pumping apparatus comprising:

a fuel sealing bellows for holding fuel leaked from a gap between a sleeve and a piston reciprocating therewithin;

a first drain passage for fuel drained from the inside of said bellows;

a second drain passage for a high pressure fuel regulator which regulates fuel pressure discharged from the high pressure fuel pumping apparatus to a prescribed value, said first and said second drain passage being merged at a merging point;

a first check valve located upstream in the first drain passage between said merging point and said bellows; and a second check valve located downstream in said first drain passage.

2. A high pressure fuel pumping apparatus according to claim 1, wherein said first check valve is a lead-type check valve and said second check valve is a ball-type check valve.

3. A high pressure fuel pumping apparatus according to claim 1, wherein said first check valve and said second check valve are integrally mounted in a casing for housing said sleeve.

4. A high pressure fuel pumping apparatus according to claim 1, wherein said first check valve is formed integrally with a lead valve for intake into and discharge from a pumping chamber formed by said sleeve and said piston.

5. A high pressure fuel pumping apparatus according to claim 1, wherein said high pressure regulator is integral with said pumping apparatus.

6. A high pressure fuel pumping apparatus according to claim 1, wherein said bellows is made of metallic material.

* * * * *